US007507169B2

(12) United States Patent
Kamen

(10) Patent No.: US 7,507,169 B2
(45) Date of Patent: Mar. 24, 2009

(54) METHOD FOR CREATING COOPERTITION

(76) Inventor: Dean Kamen, 15 Westwind Dr., Bedford, NH (US) 03110

( * ) Notice: Subject to any disclaimer, the term of this patent is extended or adjusted under 35 U.S.C. 154(b) by 0 days.

(21) Appl. No.: 10/751,166

(22) Filed: Jan. 3, 2004

(65) Prior Publication Data

US 2004/0142774 A1 Jul. 22, 2004

Related U.S. Application Data

(60) Provisional application No. 60/437,811, filed on Jan. 3, 2003.

(51) Int. Cl.
*A63B 67/00* (2006.01)

(52) U.S. Cl. ..... 473/415; 473/422

(58) Field of Classification Search ..... 473/415, 473/430, 446; 463/50, 56; 434/19, 11, 247; 273/440

See application file for complete search history.

(56) References Cited

U.S. PATENT DOCUMENTS 4,575,096 A * 3/1986 Lam ..... 273/296
5,647,747 A * 7/1997 Macri et al. ..... 434/247
5,928,093 A * 7/1999 Lai ..... 473/430
5,938,204 A * 8/1999 Tzeng et al. ..... 273/440
6,491,566 B2 * 12/2002 Peters et al. ..... 446/454
6,599,128 B2 * 7/2003 Roberts ..... 434/128
6,674,259 B1 * 1/2004 Norman et al. ..... 318/568.11
6,796,915 B2 * 9/2004 Getchell ..... 473/446
7,182,341 B2 * 2/2007 Conner ..... 273/260
2002/0155884 A1 * 10/2002 Updike ..... 463/25
2003/0075867 A1 * 4/2003 Roberts ..... 273/248
2005/0003878 A1 * 1/2005 Updike ..... 463/16
2006/0046807 A1 * 3/2006 Sanchez ..... 463/9

OTHER PUBLICATIONS http://www.botball.org/—2002 through 2007 Waybackmachine search results.*

* cited by examiner

*Primary Examiner*—Mitra Aryanpour
(74) *Attorney, Agent, or Firm*—Bromberg & Sunstein LLP

(57) ABSTRACT

One embodiment of the invention is a system and method for creating cooperation and gracious professionalism during a competition. According to one embodiment of the invention, a first participating player, team, or alliance is motivated to cooperate with a second participating player, team, or alliance by rewarding the first participating player, team, or alliance for assisting the second participating player, team, or alliance to achieve a higher score than might otherwise have been the attainable. One particular embodiment of this invention is to award the first participating player, team, or alliance that obtained the highest number of points during competition with a score comprised of the number of points obtained by the first participating player, team, or alliance plus twice the number of points obtained by the second participating player, team, or alliance.

1 Claim, 2 Drawing Sheets

Regional and *The Championship* Divisions

METHOD FOR CREATING COOPERTITION

The present application claims priority from U.S. Provisional Patent Application 60/437,811, filed Jan. 3, 2003, which application is incorporated herein by reference.

TECHNICAL FIELD

The present invention pertains to methods and systems for conducting competitions, and, more particularly, to conducting competitions that foster cooperation and gracious professionalism among the competitors.

BACKGROUND ART

FIRST (For Inspiration and Recognition of Science and Technology) was founded in 1989 to inspire an appreciation of science and technology in young people, their schools and their communities. Based in Manchester, N.H., the non-profit organization designs accessible, innovative programs to build self-confidence, knowledge, and life-skills while motivating young people to pursue opportunities in science, technology, and engineering. With the support of many of the world's best-known companies, FIRST hosts the FIRST Robotics Competition for high school students and the FIRST LEGO™ League for children 9-14 years old. For more information about FIRST, please see www.usfirst.org.

The FIRST Robotics Competition provides high school students the opportunity to work alongside professional engineers to design and build robots from a kit of parts to participate in a specific game that changes from year to year. Student teams work with corporate sponsors, colleges, and other professional mentors to compete in regional competitions leading up to the annual championship competition. The FIRST Robotics Competition, however, is about a lot more than robots. Although the pressure and excitement of the competition is intense, FIRST motivates the players to know their competitors, make friends with them, and even help them out. FIRST calls this an environment of "gracious professionalism."

Since its inception, FIRST has impacted hundreds of thousands of young people and continued to expand its reach every year. For example, in 2003, approximately 700 corporations provided sponsorship and career opportunities to the approximately 25,000 young people who participated in the FIRST Robotics Competition that year. More than 35 Universities offered more than $3.8 million in scholarships to these participants. With the significant success and growth of FIRST in general and the FIRST Robotics Competition in particular, comes the need to foster the spirit of gracious professionalism to an ever increasing group of participates, sponsors, and volunteers. While gracious professionalism is the very sole of FIRST, it would be helpful to design the annual FIRST Robotics Competition game, and any other competition where a spirit of cooperation is desired, so that the rules of the game itself foster this spirit of gracious professionalism. The FIRST Robotics Competition game over the years has structured the competition so that the teams work in changing groups (called alliances) against other groups of teams. This rotating alliance structure fosters a spirit of gracious professionalism, because an opponent in one round may be a partner in the next. While this alliance structure contributes to gracious professionalism, what is needed is a method and system for scoring such competitions to create a coopertition.

SUMMARY OF THE INVENTION

One embodiment of the invention is a system and method for creating cooperation and gracious professionalism during a competition. According to one embodiment of the invention, a first participating player, team, or alliance is motivated to cooperate with a second participating player, team, or alliance by rewarding the first participating player, team, or alliance for assisting the second participating player, team, or alliance to achieve a higher score than might otherwise have been the attainable. One particular embodiment of this invention is to award the first participating player, team, or alliance that obtained the highest number of points during competition with a score comprised of the number of points obtained by the first participating player, team, or alliance plus twice the number of points obtained by the second participating player, team, or alliance.

BRIEF DESCRIPTION OF THE DRAWINGS

The foregoing features of the invention will be more readily understood by reference to the following detailed description, taken with reference to the accompanying drawings, in which.

DETAILED DESCRIPTION OF THE INVENTION

The game is played on a 54-foot long by 24-foot wide playing field. A 2-foot high platform that is 4-feet wide by 12-feet long is located across the center of the field. The platform is accessed from each of its long sides by ramps that are 8 feet long. Two alliances of two teams each compete in each match. Each team consists of a human player, two driver/operators, and a coach. A match consists of a 10-second Human Player Period, a 15-second Autonomous Control Period, and a 1 minute and 45 second Remote Control Period. The object of the game is to acquire and stack plastic storage containers that are initially located on the platform or placed on the playing field by human players. Each alliance must place containers in a scoring zone on its own side of the field to score points. The total number of points earned depends on the count of containers located in each alliance's scoring zone multiplied by the number of containers in their highest stack. Additional points are awarded for any robot that is positioned on the top of the platform at the end of the match.

Figure 1:
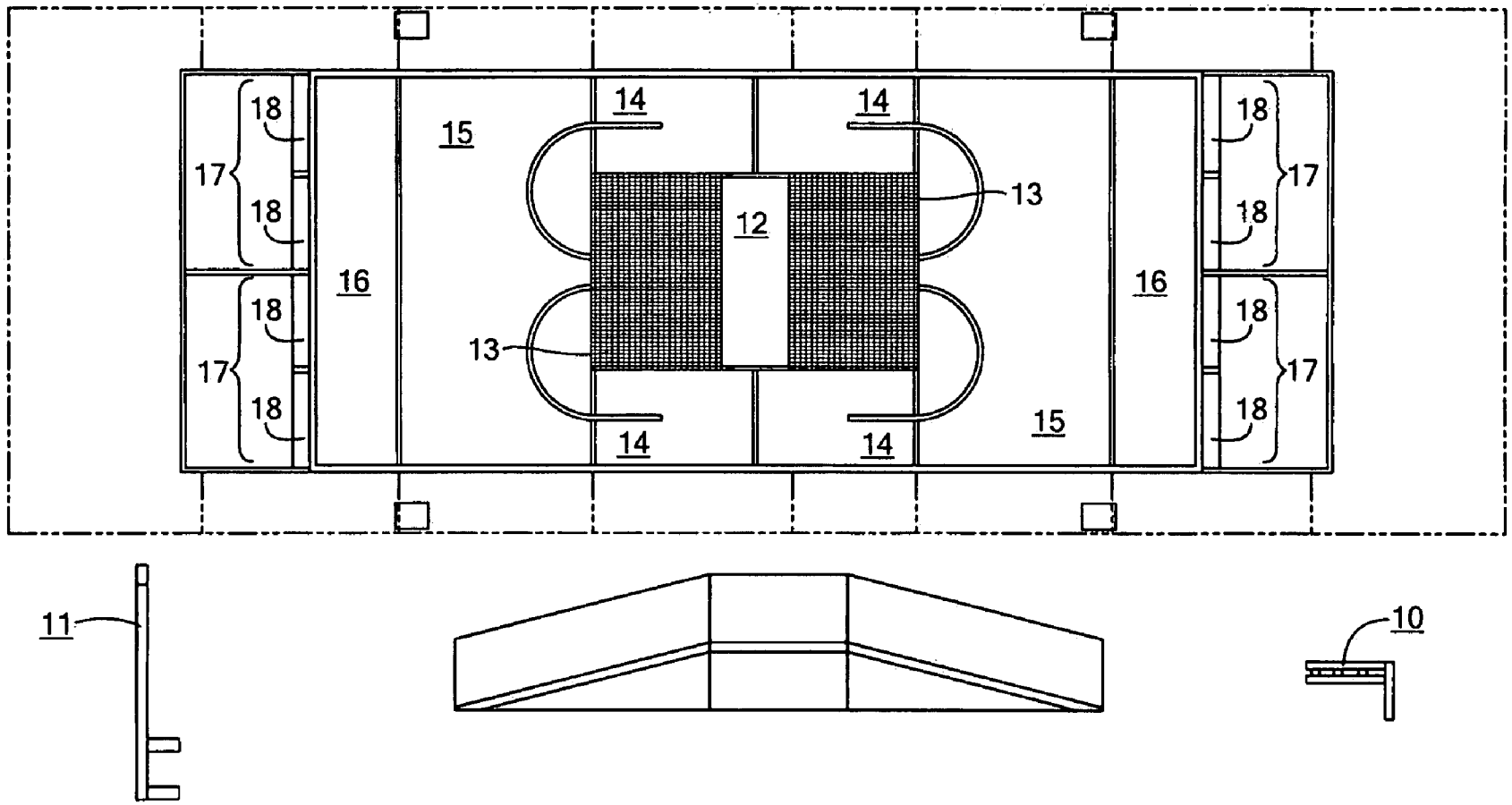
FIG. 1 shows the playing field layout.

Personal safety is of primary importance during all FIRST Robotics Competitions. Because FIRST hosts events that involve robots that depend on electrical equipment, stored mechanical energy, moving mechanical parts, and other safety hazards, Safety will not be compromised. Please use common sense and be safe! Safety rules will be strictly enforced FIG. 1 shows the playing field layout. The exact dimensions of the playing field and game components may differ slightly from competition to competition. The playing field is bounded on its long sides by a 20-inch high aluminum pipe guardrail system 10. The guardrail system 10 is fastened to the field carpet with "Velcro" fasteners. Both ends of the field have an end wall 11 consisting of a 3-foot high, 3/16" thick aluminum diamond plate end wall topped by a 4-foot high, 3/8" thick transparent acrylic safety shield, for a total wall height of about 7 feet. The driver stations are located behind end walls 11. The middle of the playing field contains the Platform 12, Ramps 13, and Starting Alleys 14. The alleys at the sides of the platform are divided at midfield by a pipe barrier whose top is 1 foot 4 inches above the floor. A 12-foot wide Scoring Zone 15 extends from the base of the ramps toward the Driver Stations. The area between the scoring zone and the drivers stations is a "No Scoring" Zone 16. The alleys 14 at the side of the platform and ramps are also no scoring zones.

The playing field and its components have a number of different surfaces:

- The playing field has a three-color carpeted surface of red, gray, and blue.
- The ramps 13 are 8 feet long by 12 feet wide (three 4'×8' sections) made of open 1" by 1" welded wire mesh. They are sloped approximately 14 degrees from horizontal.
- The platform 12 top of the ramp has a smooth, High Density Polyethylene (HDPE) surface ½" thick. The platform 12 is 4-foot wide by 12-foot long by 2-foot high. The approach ramps and ramp platform have a 2-foot-high, ½" thick, transparent polycarbonate wall along their outside edges. These walls extend down to the surface of the playing field.
- There are 2" wide white lines on the playing field that can be used by robot tracking systems.

Each field end has two alliance boxes 17 delineated by floor tape. Each alliance box has two driver stations 18. Each alliance will set-up at a driver station location as assigned by the scoring system. Competing alliances will be placed at diagonally opposite ends of the playing field. The driver stations 18 have 12-inch deep shelves located 3 feet above the floor where each team's robot control system may be placed. Teams must bring their own control systems, including radios, to the field. Each driver station will have a 15-pin male cable to provide power and control signal to the Operator Interface (OI) of each team's control system. These are to be plugged into the "Competition" port of the OI. No power outlets will be available at the driver stations.

Sterilite Corporation (www.sterilite.com), Townsend, Mass., manufactures the plastic storage containers used in this game. The game containers are 73-quart capacity, model 1730, and their color is Glacier (blue). They are approximately 24-¼" long×17-¼" wide×15-¾" high. The tops of the containers will be fastened securely to the container bodies with plastic pop-rivets. Retroreflective tape will be applied to the human-player handled containers only. Containers are readily available for purchase at stores such as Walmart, Target, and others. Sterilite will also sell to teams through their distributor but the minimum order amount is $ 250 USD.

The object of the game is for each of the alliances to score points by acquiring and stacking plastic storage containers in their own end of the playing field. Additional points are awarded to alliances whose robots are positioned on the platform at the end of each match. Prior to participating in any match, each teams robot must pass technical inspection and be within the prescribed weight and dimension limits. For a robot to be eligible to compete, it must contain the minimum components. If a robot is inoperable and unable to compete in a match, in order for that team to obtain a score, at least one member of the team must be in the team's driver station during the match. This team member may be the human player.

At the start of each match, 29 containers will be stacked in 5 tiers in a line across the top of the platform.

- The 1st (bottom), 2nd, and 3rd tiers will have 7 containers;
- The 4th tier will have 5 containers;
- The 5th (top) tier will have 3 containers.

The platform container stacks will be located approximately 3 inches apart and centered across the platform.

Robots will initially be placed within the starting areas in the alleys at the sides of the platform/ramp structure. Each alliance's robots will start on the far side of the midfield barrier.

Each alliance will have 2 human players (1 from each team) positioned outside each of the two gates at their end of the playing field. Each human player will have 4 containers stacked near him or her.

The remaining 2 players and a coach from each team must stand in their driver station on a line that is 3' from the base of the driver station.

Driver controls must be placed on the diamond plate shelf.

At a starting signal, all 4 human players will enter the field at the same time from separate gates at the sides of the field. They will have 10 seconds to place or stack their containers anywhere in their own Scoring Zone and exit the field. The human players will then stand on a pressure-sensitive mat located outside the playing field to positively indicate that they have cleared the field. Any team (not the alliance) whose human player is not off the playing field in 10 seconds will have their robots disabled during the 15-second autonomous period. Any team (not the alliance) whose human player is not off the field in 15 seconds will not be powered up and will not compete in that entire match. The autonomous operation period of the game will automatically start when the last human player leaves the field and all 4 pressure sensitive mats have been activated. The human players must then join their teams in the driver stations. As soon as the game starts, all robots will be under autonomous control (no human drivers) for a period of 15 seconds. During this time, the robots will operate and react only to sensor inputs and to commands programmed by their teams into the onboard robot control system. Operator control of the robot will not be possible during this time. The only operator control allowed during the autonomous robot control period is activating of the Emergency Stop (E-Stop) buttons located in the driver stations, which will disable that robot's power supply. A team player, not a coach, is allowed to leave the 3' line in order to activate the E-Stop button.

During the autonomous robot control period, robots may use onboard sensors to detect features of the playing field surface (e.g., the white lines or colored areas of the carpet), the containers placed in the scoring zones by the human players (which have detectable strips of retro-reflective tape on the sides of the containers), structural elements of the play field (e.g., using proximity or contact sensors to detect edges of the field or parts of the ramp structure) and/or other robots. During the autonomous robot control period, the robots may move about the field and perform any activities that would be normally permissible when operated under human control. All robot operation and safety rules applicable during the operator control period are also applicable during the autonomous robot Control period.

An E-Stop button during the autonomous period. The intent is for the E-Stop buttons to act as a safety device, not for team use to, in any way, control/modify control of its robot during the 15-second autonomous period. Upon completion of the 15-second autonomous robot control period, the driver station controls will automatically be activated. Team members will remotely control and operate their robots for the remaining 1 minute and 45 seconds of the match. Power will be automatically shut off at the conclusion of this period.

Robots try to acquire and stack (right-side up, upside down, on their side, etc.) as many containers as possible in their alliance's scoring zone 15. The "gray carpet" alleys 14 at the side of the platform/ramp structure and the "gray carpet" areas directly in front of each end of the playing field are "No Score" areas, i.e., not in the scoring zone. All containers within the alliance's scoring zone 15 will be worth one point each EXCEPT the containers in the tallest stack. The total number of one-point containers will determine the base score for the alliance. The tallest stack of containers within the scoring zone is the "multiplier stack." Containers in the multiplier stack are worth zero points each (note that containers in other stacks of the same height are worth one point each). The total base score is then multiplied by the height in whole Stack Height Units (SHU) of the multiplier stack. A whole Stack Height Unit is 14-¾ inches, which is the height of an individual container nested in a stack. More than one stack of the same height does not affect the multiplier. Whole Stack Height Units will be measured with an Official Stack Height Measuring device. The Official Stack Height Measuring Device will be marked in increments of 14-¾ inches (one wSHU). An additional 25 points will be awarded to each robot that is touching only the top of the platform 12 at the end of the match.

Both teams in the losing alliance get their own alliance score in Qualifying Points (QP's). Both teams in the winning alliance get their own score plus twice the losing alliance's score in QP's. A tie awards the total of the match points to both alliances in QP'S.

The competition is composed of two phases: Qualification Matches and Elimination Rounds. All matches are two minutes each plus 10 seconds for the human player time. In each match, two teams work together as an alliance against another 2-team alliance to collect and stack storage containers. During the qualification matches, randomly assigned teams are partnered to form alliances. Alliances last only for the duration of a match. The qualification match schedule will be provided prior to the start of the qualification matches.

At Regional Events, teams will be randomly allied with any other team at the event;

At The Championship Event, each team is assigned to one of four divisions and participates only with other teams in the same division.

Teams are ranked based on an equal number of qualification matches. For ranking, the lowest match QP score is dropped and the remaining match scores are averaged. If teams must play an extra match to fill out the matches in a competition, this extra match score and their lowest score are dropped before averaging. Following the conclusion of the qualification matches, the top-ranked teams form alliances and go on to compete in the elimination rounds.

Alliances formed for the Elimination Rounds stay together for the remainder of the event. Each elimination round alliance is composed of three teams. Only 2 teams play in an alliance at a time. The third team in the 1st match must play in the 2nd match with no exceptions. Teams should consider the robustness of the robots when picking alliance partners.

At Regional events: Eight (8) alliances compete in a series of elimination rounds until one alliance is declared the event champion;

At The Championship Event: Thirty-two (32) alliances (8 per Division) compete in a series of elimination rounds, resulting in four Division Champion alliances and one Grand Champion alliance.

Each elimination round will be comprised of 2 matches. The elimination matches will be scored exactly like the qualifying matches except that the points will be referred to as Elimination Points (EP's). Both teams in the losing alliance get their own alliance score in EP's. Both teams in the winning alliance get their own score plus twice the losing alliance's score in EP's. A tie awards the total of the match points to both alliances in EP's. After the two matches are completed, the alliance with the highest combined total EP score advances to the next round. In the event of a tied score, a 3rd and final match will be played. The highest EP score for this match advances. If the alliances are still tied, the winning alliance will be determined using the following criteria:

Alliance with the highest EP score for 1 of the 3 matches in this round;

Higher seeded alliance (1 is highest seed and 8 is the lowest seed).

The Rules

Safety Rules

All teams are responsible for providing their own safety glasses at each event and all team members must wear safety glasses in the alliance stations during matches (students and coaches). Safety glasses must be worn by everyone at all times while in the pit area.

All team members must wear sneakers or appropriate footwear while in the pit area or competing. No bare feet, no sandals, no open-toed shoes, etc.

The human players must wear safety glasses when they are competing to move and stack containers.

While on the playing field, the human players must keep their feet on the ground, i.e., they cannot stand on the field border, the containers or each other.

The human players must immediately return to their driver stations once the autonomous segment of the match begins.

The students and coach must remain in their driver station during the match.

Students and coaches may not reach into the playing field.

If, at any time, the referees or the field manager determine that a robot poses a safety hazard, the robot must be modified to the head referee or field manager's satisfaction or it will not be allowed to compete.

The storage containers are the only projectiles that may be launched by a robot.

Wireless/radio control mode is never allowed in the pit area(s). Robots may only be driven via the tether when not competing in a match.

Do not tamper with the power supply, batteries, chargers, speed controllers, joysticks or any other control system component except as noted in the control system rules. Tampering could result in failure or malfunction of the control system, and lead to a safety hazard or damage to the robot.

The 120 A circuit breaker must be easily accessible.

Turn off the 120 A main circuit breaker while making adjustments to your robot. Since the motors provided in the kit are quite powerful, it is important to keep all body parts away from all robot mechanisms while your robot is connected to the battery.

The battery can deliver more than 200 Amperes. Do not let the wires come into contact with any metal surfaces. Route wires carefully to avoid damage and short circuits that may cause serious burns, fire, and/or permanent damage to the batteries.

Game Match Rules

The "minimum robot" that may be used in a match must contain the following components:

Battery;

Robot Controller;

Radio;

Revolving Light;

Associated Wiring, Circuit Breakers, and Fuse Panel;

Team Name/Number signs.

The minimum robot must be wired such that the revolving light turns on when the autonomous mode/operator control mode is enabled.

Referees have ultimate authority during the competition. THEIR RULINGS ARE FINAL! The referees will not review any recorded replays.

ABSOLUTELY NO REMATCHES WILL BE AWARDED. FIRST reserves the right to re-play a match due to obvious catastrophic failure of FIRST-provided field materials or human error.

THERE ARE NO TIME-OUTS. The matches must progress according to schedule. If a robot cannot report for a match, the cueing manager shall be informed and at least one member of the team should report to the field for the match. Special field access badges are supplied by FIRST at each event and must be worn by the four members per team (3 "Students" and 1 "Coach") to be allowed on the playing field. The coach's badge will have a special designation identifying him or her as a coach. The coach may be a team mentor, student advisor or student.

Special clothing and/or equipment will only be allowed on the playing field for those who demonstrate a need based on a physical disability.

Teams are allowed a maximum of 1 minute to set up their robots on the playing field and a maximum of 1 minute to remove all robot parts from the field following a match. Teams should practice the coordination of placing their robot onto the field before coming to the competition.

During the setup for matches, each team must connect their operator interface to a specific driver station within their alliance station as designated by FIRST. The Qualification Match schedule distributed to the teams will indicate either a left or right driver position as viewed from the driver station looking toward the ramp. Teams will be directed during queuing to their designated driver station location. Team control systems will come in many sizes, shapes, colors, and configurations including "wearable" controls. Wearable controls, whether they are gloves, headgear, a platform hung from shoulder straps or whatever, must conform to the following:

Your OI must be on the diamond plate shelf so that its competition port can be connected with the provided DB15 cable;

Your wearable controls must be connected to one of the Ports 1-4 AND this connection must have some sort of quick connect/disconnect (of your choice) in this line;

Upon expiration of the autonomous period, you may step forward and use your quick connect and begin driving.

During the setup for each match, robots must be placed totally within their designated starting areas. In the Qualification Matches, a robot will be placed in the starting box that that is in front of its driver but on the opposite side of midfield, i.e., as viewed from the driver's perspective, the right-most driver's robot will be in the right starting spot and the left-most driver's robot will be in the left starting spot. In the Elimination Rounds, the robots can go in either position. They must sit on the carpet unconstrained in the same position as when they were in the sizing box.

Templates may not be used for robot placement on the field.

At the start of each match, 29 containers will be stacked in a line across the top platform of the ramp structure in 5 tiers: the bottom 3 tiers will have 7 containers each; the 4th tier will have 5 containers; the 5th (top) tier will have 3 containers.

During a match, four members per team (3 "Students" and 1 "Coach") are allowed in the alliance station at the end of the field. One of the students is designated as the "Human Player" and performs the human player activity as described in the rules. The students must be pre-college students from a team partner school while the coach may be an adult or student from a team partner. Coaches who happen to be pre-college students are not considered "students" with respect to rules of game play and may not engage in activities reserved for students. The students and coach from each alliance may move about within the alliance station.

During a match, the robots may be remotely operated only by the students and/or by software running in an on-board control system.

During a match, students and mentors must stand on the carpet, i.e., they may not stand on containers, the driver station shelf or any part of the field structure or on each other.

Each match lasts for two minutes plus 10 seconds for human player activity.

Contact with the containers by alliance members, other than the human players at the start of the match, is prohibited.

At a starting signal, all 4 human players will enter the field at the same time from all 4 gates at the sides of the field. They will have 10 seconds to place or stack their containers within their own scoring zone.

Human players may only travel in their own scoring zone. They are not allowed in the gray areas or on the ramps.

Human player containers must be "stacked" bottom side facing down.

Human players can only place or stack containers. They cannot throw the containers.

The human players must activate their own power-enabling pressure-sensitive mats after they exit the field. When all human players are off the playing field and all of the power-enabling pressure-sensitive mats have been activated, the robot control systems will be automatically enabled and the autonomous control period will start.

During the first 15 seconds of a match, the robots are controlled autonomously by on board inputs and onboard-programmed control systems. Subsequent to this, robot control automatically switches to the driver control stations. Matches end when control systems are disabled by the expiration of the match time unless the match is whistled dead by the referees.

Two Emergency Stop (E-Stop) buttons are located in each alliance station, one for each team. Pressing an E-Stop button will cause the corresponding team's robot to be disabled. Any member of a team may press the E-Stop button corresponding to their own robot. A team that has pressed its E-Stop button may release it, thus re-enabling their robot at any time prior to the end of a match; however, activation of the E-Stop button during the autonomous period will result in a team's robot being disabled for the remainder of the autonomous period AND for the first 30 seconds of the driver control period. The E-Stop buttons are intended for remote robot shut down during a match in the event of safety hazards and will not otherwise affect match scoring or duration. The E-Stop buttons may not be used to remotely control the robot during autonomous mode.

Any containers that leave the playing field during a match will be not be returned to the playing field until the next match.

Any container that might end up in a driver station area cannot be returned to the playing field.

Only the referees may handle or move any container on the playing field during the scoring of the match.

A damaged container may be removed from play at the referee's discretion but only after a match has been scored.

Robot shoving will be allowed and should be expected. It is very common for machines to run into each other at full speed, get into shoving matches, become entangled, and to experience the resultant forces from these actions. This should be taken into consideration when robots are designed and built. Design to endure.

Robots may not intentionally:

Detach Parts (no connection at all to a robot);

Remove the lids from the containers;

Damage another robot;

Tip over another robot;

Attach themselves to the ramp mesh or framing material;

Attach themselves to the railings/walls of any field structure.

Robot Field power will not be re-enabled after a match; however, teams may use the tether feature to make any necessary adjustments to the robot in order to release containers or to release from each other. For information on using the tether, please refer to the control system documentation from Innovation First.

Referees or field staff are not responsible for damage to robots while attempting to retrieve containers. Please design your robot so that retained containers may be released quickly and easily after a match is over.

The outer field barriers are safety features of the playing field and robots should not be designed to react against them. Reacting is grabbing or using the top of the field borders, the top of the driver stations, the top of the pipes at midfield, and the top of the platform/ramp polycarbonate sides with the intent of supporting a robot or robot part. It is also unacceptable to grab onto or push hard enough against multiple surfaces simultaneously in order to wedge and make immovable a robot. Contact with all of the barriers is acceptable. Pushing a container against a barrier is acceptable if the forces applied are not sufficient to damage the barrier or otherwise deform the playing field. Minor forces associated with activating contact sensors carried by the robots or similar minimal-force contact methods to detect and locate the field barriers are permissible.

Robots that become entangled in the field barriers, platform/ramp structure or other robots will not be freed until after the match has finished unless the entanglement represents a safety hazard. Any entangled robot may be disabled if a referee deems it necessary.

During the qualification matches, teams will not play any matches back to back, however, it is possible that a team's scheduled matches could be very close in sequence. Teams should anticipate this situation and be ready for all of their matches.

The qualification match schedule will be available Thursday evening or Friday morning. This schedule will indicate alliance partners and match pairings. It will also tell the alliance its color, RED or BLUE, for each match. The color is used to determine the placement of each team's robot, students, and coach around the playing field.

During the elimination rounds, alliances will have at least four minutes between scheduled matches.

FIRST reserves the right to randomly re-inspect and reweigh robots during the qualification and elimination phases of the competition.

Scoring Rules

The referees make all decisions regarding scoring. Referees have the ultimate authority during the competition. THEIR RULINGS ARE FINAL. The referees will not review recordings of the match.

The "Scoring Zones" for containers are the RED and BLUE carpeted areas.

The "Scoring Zone" for the robots is the top of the platform.

The "No Scoring Zones" are the GRAY carpeted areas and the ramps.

If tape is used along the "Scoring Zone" borders to protect the carpet seams, the lines will be considered part of the scoring zone.

Final scoring begins when containers and robots come to rest, which should be within 10 seconds after the match ends or upon a referee's decision. Prior to this, the referees may not see all final positions and cannot make accurate scoring decisions. If, while waiting for objects to come to rest, an object on the field changes position once a match ends and the power is turned off (i.e., a stack tips over or moves in and out of a scoring zone, etc.) and such movement causes a change in the score, the post-movement score is recorded.

Scoring containers touching the Scoring Zone in front of the RED alliance that meet the conditions in [0080] and [0081], count for the RED alliance. Scoring containers touching the Scoring Zone in front of the BLUE alliance that meet the conditions in [0080] and [0081], count for the BLUE alliance.

When determining the base score for the alliance, the referees will evaluate the containers with the following criteria:

The height of the tallest stack (tallest place/location/point) located in the scoring zone (the "multiplier stack") is measured in whole Stack Height Units (as defined in [0081]);

The total number of containers "in" a Scoring Zone will be counted and assigned one point each. A container or robot will be determined to be "in" a scoring zone if at least some part of the container or robot is touching the colored carpet that defines a scoring zone or is supported exclusively by:

Other containers "in" that zone (note: this means that if one container rests entirely in the gray "no score zone" and another container is stacked on top of it that overhangs the scoring zone, neither container will be considered to be "in" the scoring zone; the converse is true that if one container is touching a Scoring Zone and another container is stacked on top of it and overhangs the "no score zone", both containers will be considered to be "in" the Scoring Zone);

An opponent's robot "in" the scoring zone. This means that an opponent's robot holding a container in the air would count. This bullet is worth reading several times as there are some subtle and very interesting results and consequences.

The height of the tallest stack located in the scoring zone (the "multiplier stack"), measured in whole Stack Height Units (as defined in [0081]) is subtracted from the total number of containers to establish the "base score." Containers in additional stacks of the same height will be scored normally;

If ANY parts of your own alliance's robots are in contact with ANY container in your own Scoring Zone in a stack (alone or in a multi-container stack), ALL containers in that stack will be worth zero points.

Opponent robots in contact with containers in the alliance scoring zone will not affect the determination of the base score;

A container may touch the field border.

When identifying the multiplier stack, the referees will base their evaluation on the following criteria:

Only stacks located "in" a scoring zone (as defined in [0080]) are eligible to become multiplier stacks;

The tallest stack in the alliance scoring zone will be determined to be the multiplier stack. Its height is measured in whole Stack Height Units (SHU) as described previously in Section 7.6;

Multiplier stacks must have a continuous chain of contact through a set of containers from the Scoring Zone (stack starts with a container touching the carpet in the Scoring Zone) to the highest point on the stack (e.g., stacks supported EXCLUSIVELY by an opponent robot, in which there is no direct contact between the stack and the Scoring Zone, are ineligible to be the multiplier stack—any containers in such a stack are only included in the base score, as identified in Rule [0080]).

If ANY part of an alliance robot is in contact with ANY container in a stack, that stack will not be eligible to be the multiplier stack. In this event, the next-tallest stack will become the multiplier stack;

There will be only one multiplier stack. If there are multiple stacks of the same height, the redundant stacks will be scored normally as part of the alliance base score;

Opponent robot contact with a stack will not affect multiplier stack eligibility.

In the event that a robot is damaged to the point where parts become detached from the robot, the detached parts are not considered when determining whether or not the robot is "on" the platform or "in contact" with a container. In the event that large sections of the robot break apart, the section containing the Robot Controller is considered "the robot." Any part that is still connected to the robot, no matter how loosely is considered part of the robot.

A team is declared a no-show if no member of the team is in the alliance station at the start of the match.

Qualification Matches

All teams start each competition event with zero (0) qualification points (QP's) and accumulate QP's throughout the qualifying matches.

Teams that do not show up for a scheduled qualification match will receive zero (0) match points and zero (0) QP's. Participating teams will receive their match score and QP's as normal.

The winner of a match is the alliance with the highest score.

In each qualifying match, all teams that participated in the match receive QP's as follows:

Each team in the losing alliance receives their match score in QP's;

Each team in the winning alliance receives their own score plus double the number of match points of the losing alliance in QP's;

If 1 team is disqualified, the match will be played as a 2 on 1 and scoring is as normal; the DQ'd team will receive 0 QP's;

If an entire alliance is disqualified, the other alliance receives double their own score in QP's; the DQ'd alliance will receive 0 QP's;

Ties are allowed. In the event of a tie, all 4 teams get the total of the scores of both the RED and BLUE alliances;

At the conclusion of all of the qualification matches, teams are ranked by dropping their lowest QP score and averaging the rest. If teams must play an extra match to balance out the matches in a competition, the score of the extra match and their lowest score are dropped before averaging.

Teams will be ranked using the following hierarchy of criteria (in order from most to least important):

1. Highest average qualifying point total;
2. Highest number of matches won during qualification matches;
3. Highest match score;
4. Flip of a coin.

Elimination Rounds

All teams start the elimination rounds with zero (0) elimination points (EP's) and accumulate EP's throughout the elimination rounds.

Alliances that do not show up for a scheduled match will receive zero (0) match points and zero (0) EP's. Participating alliances will receive their match score and EP's as normal.

The alliances play 2 matches. The elimination rounds will be scored exactly like the qualifying matches.

The winner of a match is the alliance with the highest score.

In each elimination match, each alliance will receive EP's as follows:

The losing alliance receives their match score in EP's;

The winning alliance receives their own score plus double the number of match points of the losing alliance in EP's;

If 1 team is disqualified, that entire alliance is DQ'd; the DQ'd alliance will receive 0 EP's and the other alliance receives double their own score in EP's;

Ties are allowed. In the event of a tie, both alliances get the total of the scores of both the RED and BLUE alliances;

The alliance with the highest total EP score advances to the next round;

In case of a tie, one more match is played, whereby the highest EP score for this match advances. If still tied, the winning alliance will be determined using the following criteria:

Alliance with the highest EP score for 1 of the 3 matches in this round;

Higher seeded alliance (1 is highest seed and 8 is the lowest seed).

Game Violations

Any safety violations during the match, e.g., not wearing safety glasses, is at least 2 minor penalties and increases with the severity of the violation.

All alliance members must remain in the alliance station during play. The human player must remain in the human player area until his/her play is done at which time he/she must return to his/her alliance station. If an alliance member steps out of the alliance station for reasons of personal safety, no penalty will be imposed. If an alliance member inadvertently steps out of the defined driver-station area during a match and it does not affect the outcome of the match, then they will receive a minor penalty.

All alliance members must remain in the alliance station after a match has ended until the referee or field manager signals that the field can be cleared.

Repeated minor infractions will result in increasingly severe penalties. Referees will indicate penalties by throwing down flags color coded to indicate which alliance/team is being penalized.

Minor Penalty #1: Warning;

Minor Penalty #2: Warning;

Minor Penalty #3: Final warning and disablement for the remainder of the match.

In the qualification matches, the penalties are given to an individual team; in the elimination rounds, the penalties are given to the alliance.

Tournament Rules

Competition at each FIRST Robotics Competition event is composed of two phases:

Qualification (Seeding) Matches;

Elimination Rounds.

The qualification matches are open to all event-registered teams that pass robot inspection. They consist of a series of matches in which teams are randomly allied with each other. Based on the results of the qualification matches, teams are ranked. The top seeded teams automatically qualify to advance to the elimination rounds. Additional teams are chosen as alliance partners by the top-seeded teams and also advance to the elimination rounds.

During qualification matches, randomly assigned teams are partnered to form alliances. Alliances last only for the duration of a match. The qualification match schedule will be available Thursday evening or Friday morning.

At Regional Events, teams will be randomly allied with any other team at the event.

At The Championship Event, each team is assigned to one of four divisions and participates only with other teams in the same division.

Following the conclusion of the qualification matches, the top ranked teams form alliances and go on to compete in the elimination rounds.

Prior to the start of the elimination rounds, one student member of the highest-seeded team from each alliance must be identified as the alliance captain. She/he cannot delegate her/his captain authority to anyone else once selected. Alliance captains must be part of the field crew for the team. Each alliance captain must wear the "alliance captain designation" supplied by FIRST to indicate his/her special role in the alliance. Alliance captains are responsible for selecting which two of the three alliance teams will compete in each match and they are the final arbiters within the alliance.

Alliances formed for the elimination rounds stay together for the remainder of the event and may not be changed. Each elimination round alliance is composed of three teams. Only 2 teams play in an alliance at a time. The third team in the 1st match must play in the 2nd match with no exceptions. Teams should consider the robustness of the robots when picking alliance partners.

Alliance Selection

Eight (8) alliances at Regional Events and thirty-two (32) alliances (8 per division) at The Championship Event qualify to advance to the elimination rounds. The alliances are formed as follows:

For Regional Events: From the top eight (8) seeded teams, starting with the #1 seed and proceeding sequentially through the #8 seed, a pre-college student representative selects an alliance partner from among the remaining un-partnered teams. After all eight teams have selected their first partner, the process repeats and a second partner is selected.

For The Championship Event: Teams are evenly divided up into 4 "divisions." Within each division, from the top eight (8) seeded teams, starting with the #1 seed and proceeding sequentially through the #8 seed, a pre-college student representative selects an alliance partner from among the remaining un-partnered teams. After all eight teams have selected their first partner, the process repeats and a second partner is selected.

Teams may decline an offer when asked to ally for the elimination rounds; however, if a team declines, they are no longer eligible to be chosen as an alliance partner. In the event that there are not enough eligible teams to complete the number of alliances needed for elimination rounds, teams that have declined may be chosen only after all eligible teams.

Figure 2:
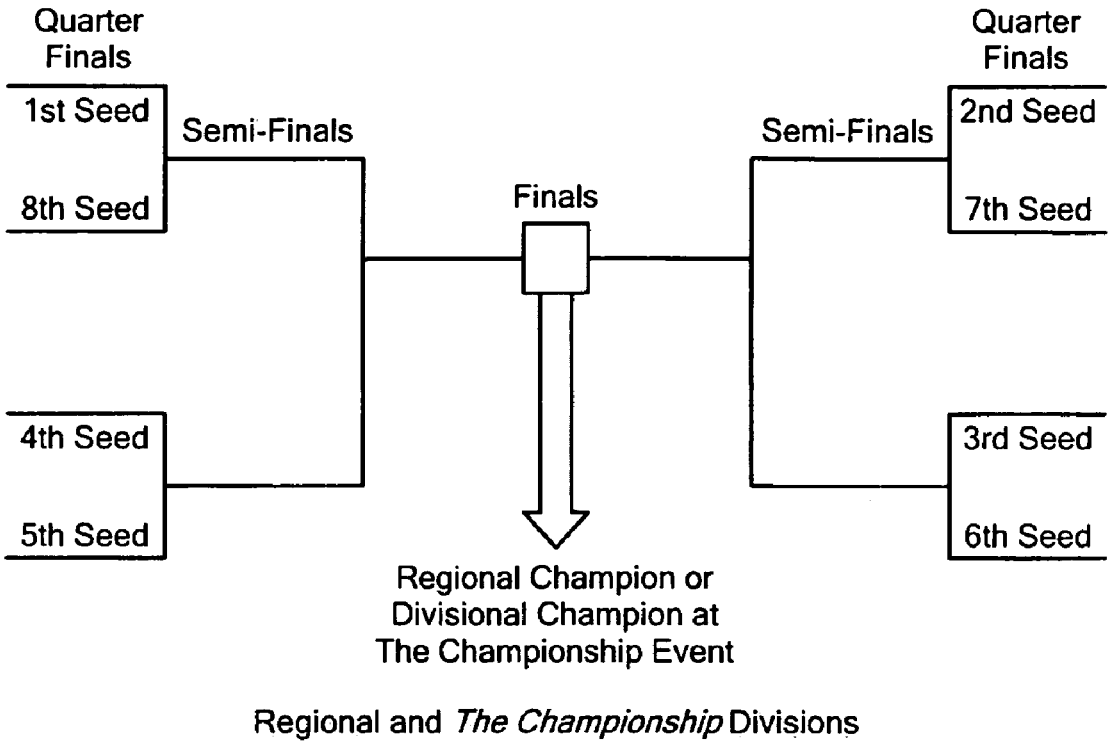
FIG. 2 shows the structure of the competition for the Regional competitions and the Championship Divisional competition.

Alliances competing in the elimination matches are paired as follows:

For Regional Events and the Divisions at The Championship Event: All series are 2 matches. In the event of a tie after the 2 matches, the winning alliance will be determined as described in [0085]. The alliance led by the 1st seed competes against the alliance led by the 8th seed in a series of quarterfinal matches; the alliance led by the 2nd seed competes against the alliance led by the 7th seed in a series of quarterfinal matches, etc. Winners of the quarterfinal matches compete against each other in a series of semifinal matches. Winners of the semi-final matches compete against each other in a series of final matches with the winning alliance becoming the Regional Champion, as shown in FIG. 2.

Figure 3:
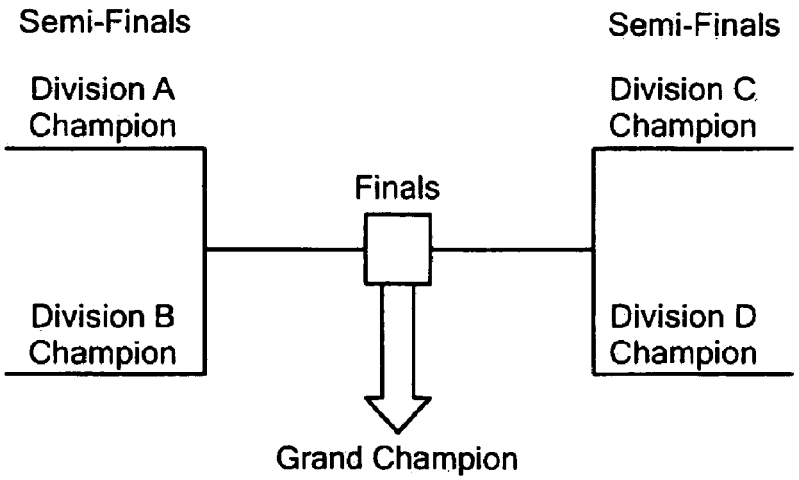
FIG. 3 shows the structure of competition for the Championship Event at the Championship competition.

For The Championship Event Championship: All series are 2 matches. In the event of a tie after the 2 matches, the winning alliance will be determined as described in [0085]. Division Champions compete against each other in a series of semi-final matches. For the semi-finals, the Division Champions will compete against each other based on the divisions they came from and will not be ranked relative to each other. The division pairings will be announced in the future on the FIRST web site after the division names have been finalized. The winners of the semi-final matches then compete in a series of matches with the winning alliance becoming The Grand Champions, as shown in FIG. 3.

The described embodiments of the invention are intended to be merely exemplary and numerous variations and modifications will be apparent to those skilled in the art. All such variations and modifications are intended to be within the scope of the present invention as defined in the appended claims.

What is claimed is:

1. A method for fostering coopertition and gracious professionalism among students while inspiring an appreciation of science and technology, the method comprising:

1) establishing a contest played on a playing field with at least four robots, such robots designed and built with participation of such students, such contest requiring accomplishment repetitively of a designated physical task on the playing field, wherein:

2) (i) each robot is controlled by a distinct team of students and designed to repetitively accomplish the physical task, performance of which on the playing field by a given robot triggering attribution to a score based on frequency of achievement of the physical task by the given robot; and 3)(ii) the contest is conducted in matches between two competing alliances of the teams, each match including a plurality of teams from each alliance;

4) assigning a raw score after each match to each alliance based on frequency of achievement of the task by robots of each team in each such alliance;

5) determining a final score for a winning alliance in each match, such winning alliance having a raw score exceeding the raw score of the other alliance by enhancing the raw score of the winning alliance by adding to the raw score of the winning alliance the raw score of the other alliance, so that the winning alliance is thus motivated to cause the other alliance to achieve a high raw score, and the teams of each alliance must work cooperatively;

6) setting a final score for the other alliance in each match equal to the raw score achieved by that alliance; and 7) ranking the teams based on the final scores achieved in matches in which they participate;

8) so that the students, by engaging in the contest, are provided with an experience involving science and technology under processes as recited herein that motivate cooperation in the midst of competition for a highest final score on the playing field.

* * * * *

UNITED STATES PATENT AND TRADEMARK OFFICE

CERTIFICATE OF CORRECTION

PATENT NO. : 7,507,169 B2
APPLICATION NO. : 10/751166
DATED : March 24, 2009
INVENTOR(S) : Dean Kamen It is certified that error appears in the above-identified patent and that said Letters Patent is hereby corrected as shown below:

In Col. 15, line 8
Add the word "twice" immediately after the word "alliance"

Signed and Sealed this

Ninth Day of February, 2010

David J. Kappos

David J. Kappos
*Director of the United States Patent and Trademark Office*